US005445505A

United States Patent [19]

Hung

[11] Patent Number: 5,445,505

[45] Date of Patent: Aug. 29, 1995

[54] MANUAL/PNEUMATIC DUAL-CONTROL OIL PUMP

[76] Inventor: Michael Hung, 9-16, Nan Kan Hsia, Nan Kan, Lu Chu Hsiang, Tao Yuan County, Taiwan

[21] Appl. No.: 238,019

[22] Filed: May 3, 1994

[51] Int. Cl.[6] ..... F04B 9/14

[52] U.S. Cl. ..... 417/374

[58] Field of Search ..... 417/374, 360, 454, 384

[56] References Cited

U.S. PATENT DOCUMENTS

| | | | |
|---|---|---|---|
| 1,771,319 | 1/1925 | Manzel | 417/374 |
| 2,358,949 | 9/1944 | Trautman | 417/374 |
| 3,231,148 | 3/1964 | Miller | 417/374 |
| 4,703,916 | 11/1987 | Hung | 254/93 H |
| 5,118,265 | 6/1992 | Bearss | 417/454 |
| 5,282,724 | 2/1994 | Reynolds | 417/454 |

FOREIGN PATENT DOCUMENTS

| | | | |
|---|---|---|---|
| 982422 | 6/1943 | France | 417/374 |
| 1731983 | 5/1992 | U.S.S.R. | 417/384 |

*Primary Examiner*—Richard A. Bertsch
*Assistant Examiner*—Ted Kim
*Attorney, Agent, or Firm*—Wenderoth, Lind & Ponack

[57] ABSTRACT

A manual/pneumatic dual-control oil pump facilitates a manual operation and pneumatic operation. The housing of the oil pump is provided with a pair of chambers receiving modular check valves, respectively. Hydraulic equipment can be connected to the oil pump through a high pressure hose. The two chambers are in communication with each other and the outlets of the chambers join together at a delivering conduit through which the liquid is supplied to the hydraulic equipment. Each modular check valve unit forms several check valves which can thus be replaced at one time in their entirety.

1 Claim, 4 Drawing Sheets

MANUAL/PNEUMATIC DUAL-CONTROL OIL PUMP

BACKGROUND OF THE INVENTION

1. Field of the Invention

This invention relates to an oil pump, and more particularly, to a manual/pneumatic dual-control oil pump which can operate manually or pneumatically.

2. Description of the Prior Art

A conventional jack assembly powered by hydraulic liquid generally comprises an oil pump and a cylinder. Those basic units are interconnected by hoses which sustain high liquid pressure. Accordingly, a complete and complicated hydraulic system is established. Because there are no directional limitations on the cylinder, the cylinder can be disposed on a steel truss in various orientations and can thus serve as a hydraulic puller, hydraulic bender, hydraulic fixer and hydraulic press.

Conventional oil pumps can be operated either manually or pneumatically. In the manual type, a lever is used to actuate the pump plunger. The operating mechanism is simple and the speed at which the plunger can be actuated is slow. Accordingly, a micro control can be carried out through the manual operation. In the pneumatically operated type, the speed at which the plunger is actuated too fast to control the operation of the pump accurately. In conclusion, both the manual and pneumatic operated oil pump have distinct advantages and drawbacks, respectively. Moreover, those two types of oil pumps cannot be used to replace each other.

SUMMARY OF THE INVENTION

It is the object of this invention to provide a manual/-pneumatic dual-control oil pump. The housing of the oil pump is provided with an oil conduit. A pair of interconnected chambers communicate with the oil conduit. Each of the two chambers accommodates a modular check valve unit of the type disclosed in U.S. Pat. No. 4,703,916 which is hereby incorporated by reference. With this arrangement, the oil pump can be operated manually or pneumatically. Further, the outlets of the chambers join together and extend to a connector for connecting the pump to a high liquid pressure hose. The hose can be connected to hydraulic equipment. The oil pump can be operated in a manual or pneumatic mode to meet different working conditions and requirements. As a result, the pressure can be elevated at a very slow speed as well as at a very fast speed.

It is still another object of the present invention to provide a manual/pneumatic dual-control oil pump having check valves that can be easily installed and replaced. The check valve are in the form of a modular check valve unit having a safety valve.

BRIEF DESCRIPTION OF THE DRAWINGS

The structural and operational characteristics of the present invention and its advantages as compared to the known state of the prior art will be better understood from the following description, in conjunction with the attached drawings which show illustratively but not restrictively an example of a manual/pneumatic dual-control oil pump. In the drawings.

DETAILED DESCRIPTION OF THE PREFERRED EMBODIMENT

Figure 1:
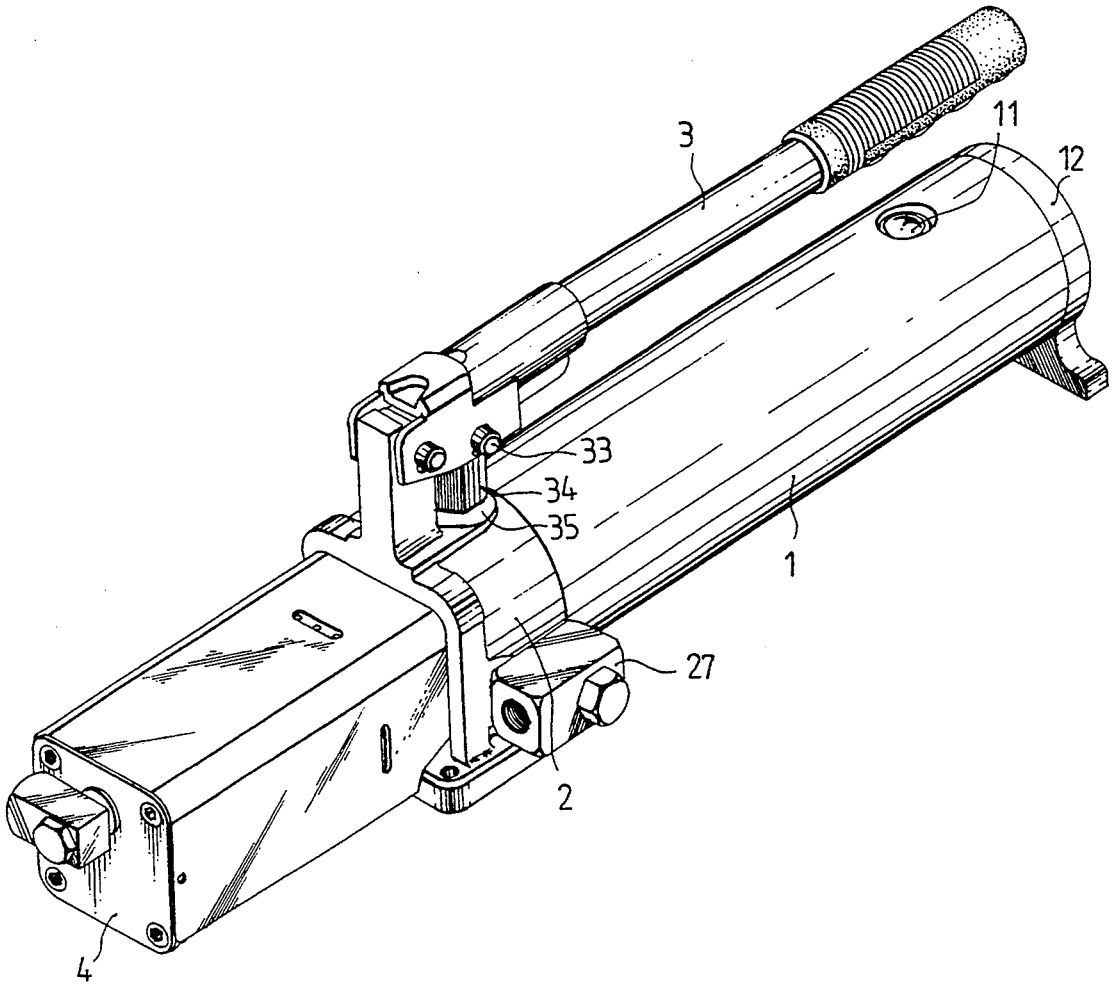
FIG. 1 is a perspective view of an assembled oil pump according to the present invention.
Figure 2:
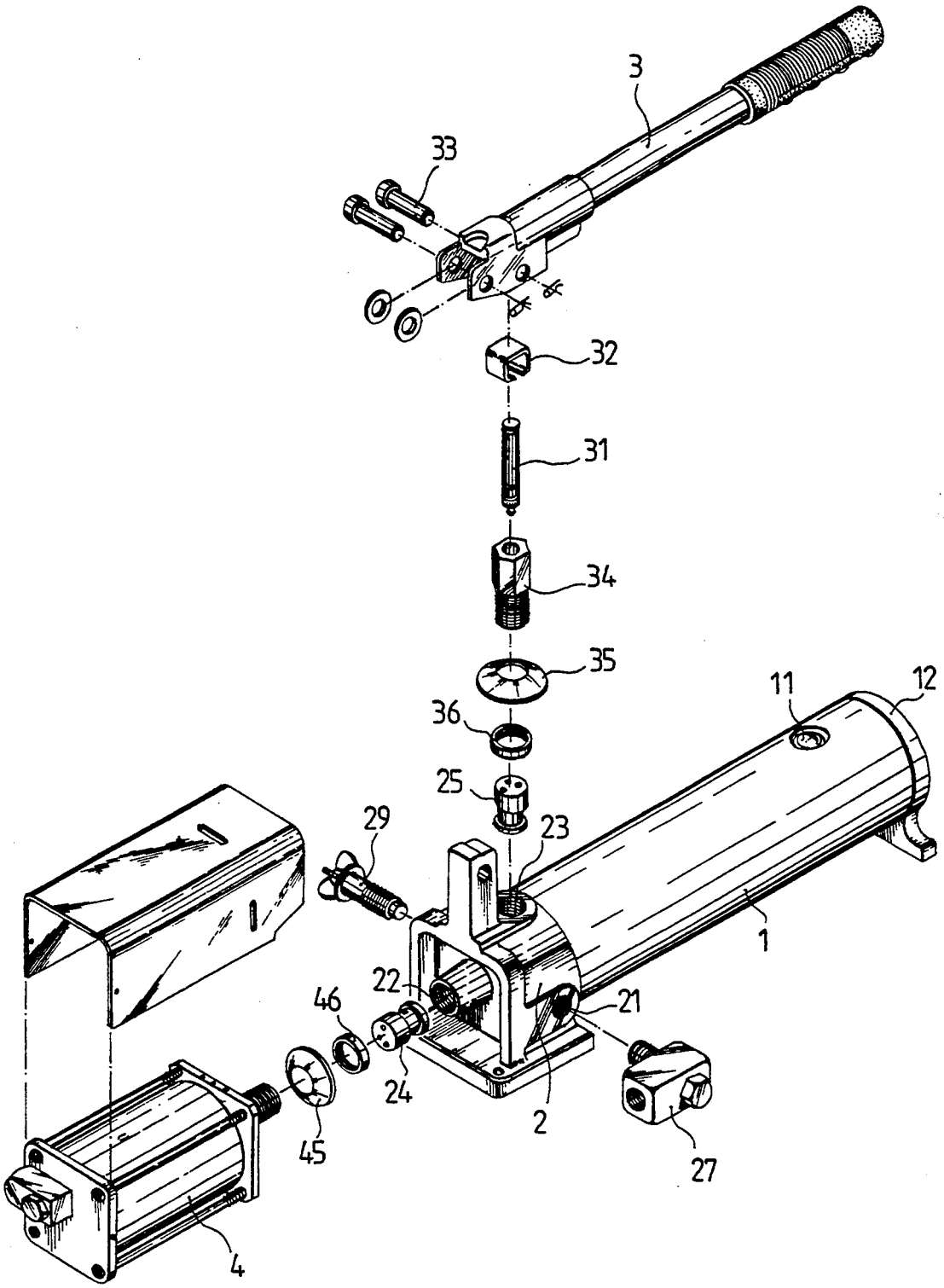
FIG. 2 is a perspective exploded view of the oil pump according to the present invention.

Referring to FIGS. 1 and 2, the invention includes an oil reservoir 1, a housing 2, a lever 3 and a pneumatic motor 4.

Figure 3:
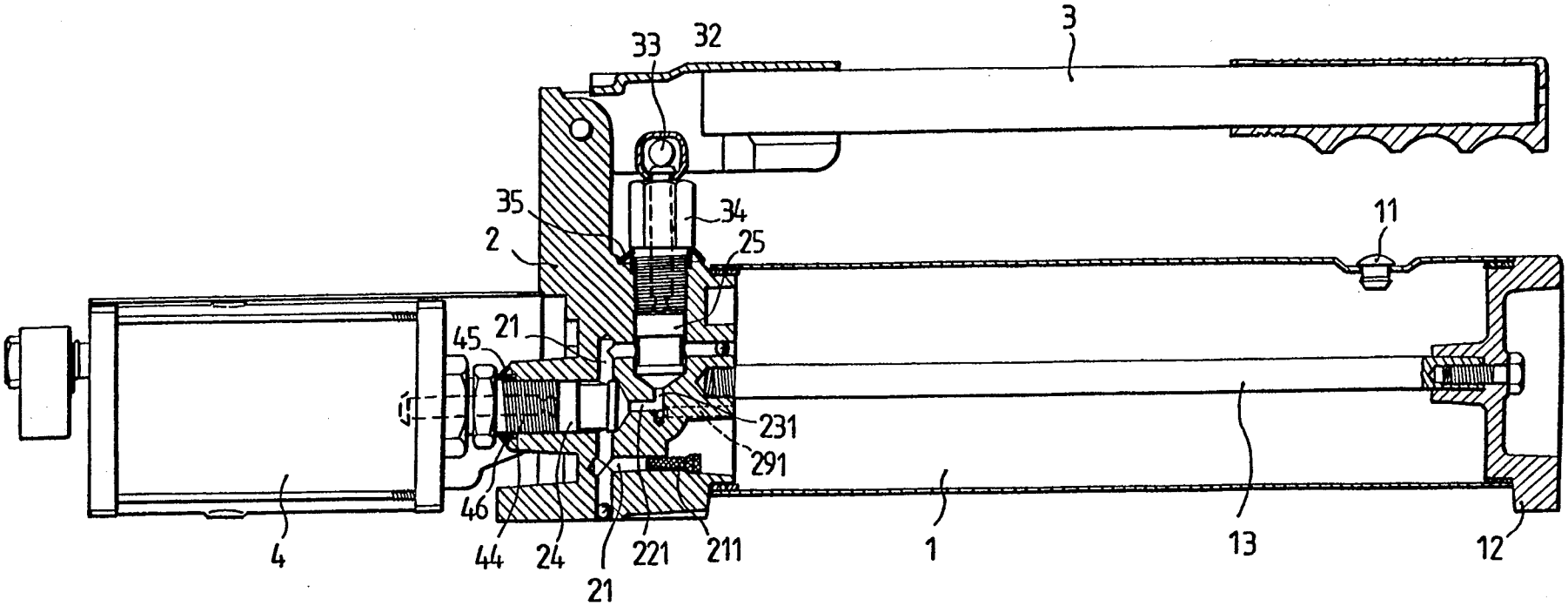
FIG. 3 is a longitudinal sectional view of the oil pump of FIG. 1.

The oil reservoir 1 has an orifice in the outer wall thereof for allowing the reservoir to be refilled with liquid. The orifice is closed by a plug 11. As shown in FIG. 3, a cover 12 is disposed over one end of the oil reservoir 1. The oil reservoir 1 is fixed by a bolt 13 between the cover 12 and housing 2. Because this portion of the pump is the same as that of a conventional pump, no further description thereof will be made.

The housing 2 is disposed at the other end of the oil reservoir 1. The housing 2 is provided with an oil conduit 21 which is in communication with the oil reservoir 1. A filter 211 is disposed at the inlet of the conduit 21. A pair of valve chambers 22 and 23 are open to the conduit 21 such that the valve chambers 22, 23 are also in communication with each other. Modular valve units 24, 25 are disposed within the valve chambers, respectively. Outlets 221, 231 of the cylinder chambers 22, 23 are joined together by a delivering conduit 26. The delivering conduit 26 is connected to a connector 27 of a high pressure hose 28 which is connected to the hydraulic powered equipment. On the other hand, the housing 2 is provided with a relief conduit 291 at one side of the housing 2. A relief valve 29 is provided to control the degree to which the relief conduit 291 is open.

The lever 3 is pivotably connected at one end thereof to the housing 2. The lever 3 is connected to a plunger 31 which extends into the valve chamber 23 of the housing 2. The plunger 31 is retained by a bracket 32 through which a pin 33 passes. The plunger 31 passes into a screw cap 34 delimiting the valve chamber 23. The screw cap 34 is threaded to the housing 2 over a washer 35 and a seal 36.

The pneumatic motor 4 is connected to the other side of the housing 2. The pneumatic motor 4 is of the type disclosed in U.S. patent application Ser. No. 08/049,299 filed Apr. 20, 1993, which is hereby incorporated by reference. One end of the pneumatic motor 4 is connected to a plunger 37 similar to that of plunger 31. A screw cap 44, a washer 45 and a sealing 46 position the plunger within the valve chamber 22 of the housing 2.

Figure 4:
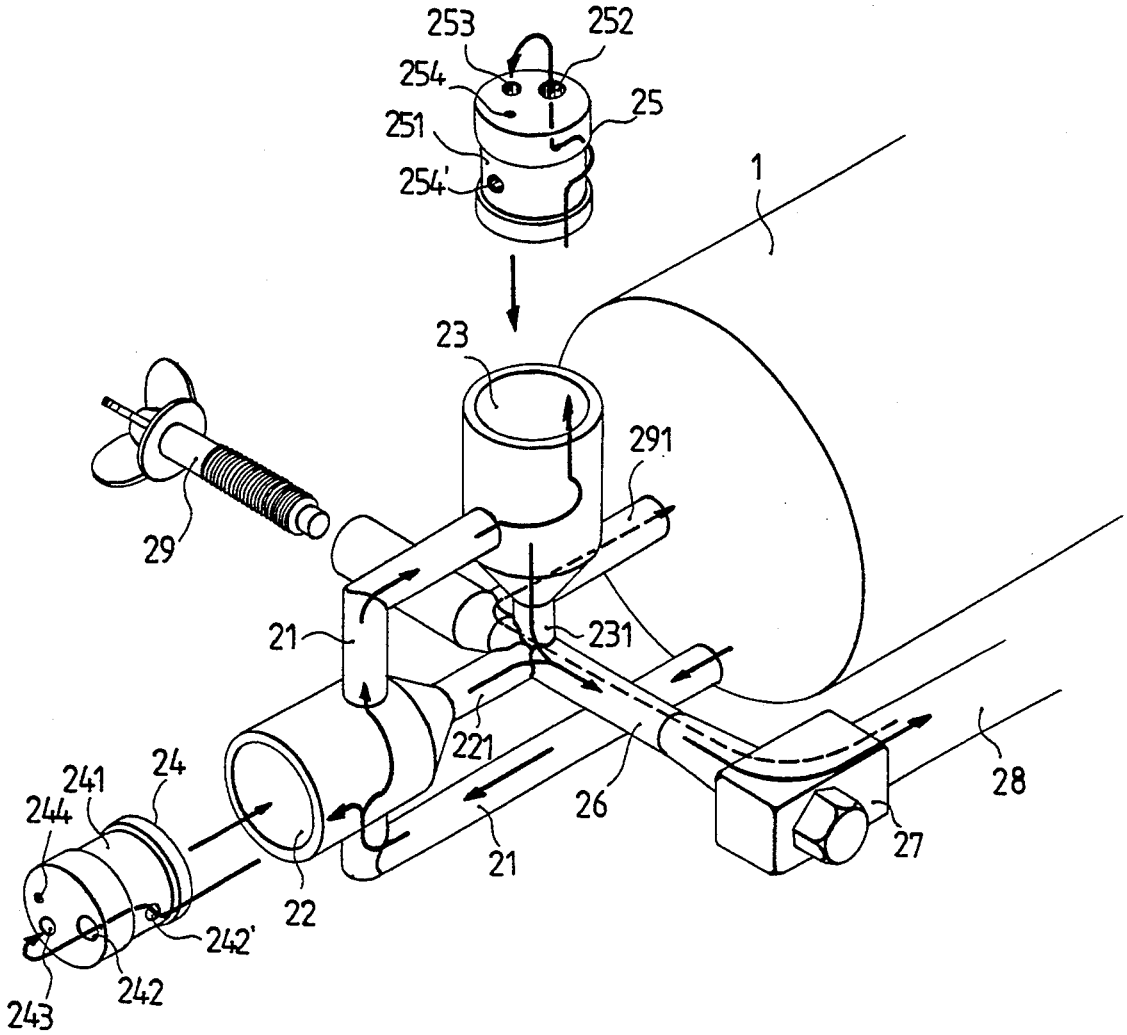
FIG. 4 is a schematic diagram of the hydraulic unit of the oil pump.

As shown in FIG. 4, the check valve unit 24 or 25 is a modular unit, as described in U.S. Pat. No. 4,703,916, issued on Nov. 3, 1987. The valve unit 24 (25) has a cylindrical configuration having an annular recess 241 (251). A pair of orifices 242 (252), 243 (253) are provided in the top surface of the valve member 24 (25). An inlet 242' of the check valve orifice 242 is provided in the wall defining the annular recess 241. The other check valve orifice 243 (253) passes through the cylindrical body so as to be open at both ends thereof. A safety valve orifice 244 (254) is provided in the top surface of the cylindrical body. Each of the check valve orifice 242 (252), 243 (253) and the safety check valve orifice 244 (254) is provided with a ball and biasing spring, not shown in the Figure. Each orifice 244 (254)

has an outlet (254' being shown in FIG. 4) open to the annular recess 241 (251). The rating of the biasing spring disposed within the safety check valve 244 (254) is larger than that of the biasing spring disposed within the check valve orifice 243 (253). As a result, the liquid may flow back to the oil reservoir 1 through the conduit and the safety check valve orifice 244 (254) if the check valve orifice 243 (253) is blocked.

In actual operation, the relief valve 29 is closed prior to a manual or pneumatic operation. When the pneumatic mode is selected, the pneumatic motor will reciprocate the plunger. Accordingly, liquid within the oil reservoir 1 is drawn into the valve chamber. In this situation, the liquid fills the annular recess 241 of the check valve unit 24 and the liquid flows into the check valve unit orifice 242 through the inlet orifice 242. Further the liquid flows to the delivering conduit 26 and then to the connector 27 through the check valve orifice 243. The liquid then flows through the high pressure hose 28 connected to hydraulic equipment, not shown in the figures, so as to operate the hydraulic equipment.

When the operator selects a manual operation, again the relief valve 29 is first closed. The lever 3 is then pumped to draw the liquid into the chamber 23 from the oil reservoir 1. The liquid fills the annular recess 251 of the check valve unit 25. Then the liquid flows through the check valve orifices 252, 253 via the inlet and at last to the delivering conduit 26. Further, the liquid flows to the connector 27 through the check valve orifice 243. Again, this liquid flows through the high pressure hose 28 connected to a hydraulic equipment, not shown in the figures, to operate the hydraulic equipment.

As described above, the ratings of the spring biasing the check valve member in the safety check valve orifice 244 (254) is larger than the spring biasing the check valve member within the check valve orifice 243 (253). Accordingly, during a normal operation, the safety valve is closed and the liquid flows to the delivering conduit 26. If the delivering conduit 26 is blocked and the pressure inside the conduit is increased tremendously, the safety valve will open and the liquid will flow back to the oil reservoir 1 through the safety valve orifice 244 (254), outlet (254') and the annular recess 241 (251).

Although the present invention has been described in connection with the preferred embodiments thereof, many other variations and modifications will now become apparent to those skilled in the art without departing from the scope of the invention. Therefore, the present invention is not limited to the specific embodiments described herein but includes all embodiments embraced by the scope of the appended claim.

I claim:

1. A manual/pneumatic dual-control oil pump comprising: an oil reservoir; a pneumatic motor; a housing to which said oil reservoir and said pneumatic motor are connected, said housing defining an oil conduit communicating with said oil reservoir, a pair of chambers communicating with said conduit, said chambers having outlets, respectively, and a delivering conduit at which the outlets of said chambers join together; a manually operatable lever connected to said housing; a first plunger connected to said lever and extending into one of said chambers in the housing so as to reciprocate in said one of the chambers as said lever is being manually operated; a second plunger connected to said pneumatic motor and extending into the other of said chambers in the housing so as to reciprocate in said other of said chambers as said pneumatic motor is being operated; a respective modular check valve disposed in each of said chambers in the housing; and a hose connector connected to said delivering conduit.

* * * * *